US008083538B2

(12) United States Patent
Ofenloch et al.

(10) Patent No.: US 8,083,538 B2
(45) Date of Patent: Dec. 27, 2011

(54) INSULATION DISPLACEMENT CONTACT WITH SEPARATION POINT AND CONTACT ARRANGEMENT WITH INSULATION DISPLACEMENT CONTACT

(75) Inventors: Markus Ofenloch, Buerstadt (DE); Sebastian Zabeck, Weinheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/691,368

(22) Filed: Jan. 21, 2010

(65) Prior Publication Data

US 2010/0197163 A1 Aug. 5, 2010

(30) Foreign Application Priority Data

Jan. 30, 2009 (DE) ..... 10 2009 006 828

(51) Int. Cl.
*H01R 4/24* (2006.01)

(52) U.S. Cl. ..... 439/404; 439/941

(58) Field of Classification Search ..... 439/391–398, 439/402–405, 941
See application file for complete search history.

(56) References Cited

U.S. PATENT DOCUMENTS

| | | | | |
|---|---|---|---|---|
| 4,116,522 A | | 9/1978 | Reynolds | |
| 4,262,984 A | | 4/1981 | Takahashi | |
| 4,310,212 A | | 1/1982 | Aujla et al. | |
| 4,408,824 A | * | 10/1983 | Weidler | 439/398 |
| 4,410,229 A | | 10/1983 | Stephenson | |
| 4,548,459 A | | 10/1985 | Mosser, III | |
| 4,767,353 A | * | 8/1988 | Hughes et al. | 439/398 |
| 4,772,234 A | * | 9/1988 | Cooper | 439/851 |
| 4,895,531 A | * | 1/1990 | Vignoli | 439/398 |
| 5,088,933 A | * | 2/1992 | Ribbeck | 439/395 |
| 5,827,087 A | | 10/1998 | Yamasaki | |
| 6,050,842 A | * | 4/2000 | Ferrill et al. | 439/404 |
| 6,060,842 A | * | 5/2000 | Lin et al. | 315/291 |
| 6,296,513 B1 | * | 10/2001 | Ishikawa et al. | 439/403 |
| 7,374,449 B2 | * | 5/2008 | Demuth et al. | 439/404 |

FOREIGN PATENT DOCUMENTS

| | | | |
|---|---|---|---|
| DE | 3214896 | C1 | 6/1983 |
| DE | 19818747 | A1 | 10/1998 |
| DE | 19945412 | A1 | 3/2000 |
| EP | 0021730 | A1 | 1/1981 |
| EP | 0101290 | A2 | 2/1984 |
| EP | 0315345 | A2 | 5/1989 |

OTHER PUBLICATIONS

European Search Report, application No. 10000924.0-2214, dated Apr. 6, 2010, 8 pages.

Deutsches Patent-und Markenamt, application No. 102009006828.7-34, dated Nov. 20, 2009, 5 pages.

* cited by examiner

*Primary Examiner* — Thanh Tam Le
(74) *Attorney, Agent, or Firm* — Barley Snyder

(57) ABSTRACT

The invention relates to an insulation displacement contact for contacting an electrical conductor and to a contact arrangement with at least one insulation displacement contact. In order to limit contacting forces in such a way that the contact arrangement undergoes no substantial deformation, the insulation displacement contact includes at least one insulation displacement arm having a separation point, which limits movements of a free end of the at least one insulation displacement arm, which is brought about by the contacting process.

16 Claims, 4 Drawing Sheets

INSULATION DISPLACEMENT CONTACT WITH SEPARATION POINT AND CONTACT ARRANGEMENT WITH INSULATION DISPLACEMENT CONTACT

CROSS-REFERENCE TO RELATED APPLICATIONS

This application claims the benefit of the filing date under 35 U.S.C. §119(a)-(d) of German Patent Application No. 10-2009-006828.7 of Jan. 30, 2009.

FIELD OF THE INVENTION

The invention relates to an electrical contact arrangement, in particular, to an electrical contact arrangement having at least one insulation displacement contact for contacting a sheathed electrical conductor.

BACKGROUND

Insulation displacement contacts and electrical contact arrangements with insulation displacement contacts offer a simple solution for contacting a conductor sheathed with an electrically insulating material. When using insulation displacement contacts, the insulation sheathing the electrical conductor does not need to be removed therefrom, prior to the contacting. Instead, an insulation displacement portion, which is provided with a blade or cutting edge, of the insulation displacement contact cuts during the contacting process through the insulation of the conductor, until the insulation displacement portion rests against the core of the conductor and forms an electrical connection therewith. The core of the conductor generally consists of an electrically conductive wire or wire mesh, for example made of copper, into which the insulation displacement portion is unable to significantly cut during the contacting process.

In order to mechanically secure the connection between the insulation displacement contact and conductor, the conductor is inserted into an insulation displacement channel, which tapers in its course is pointing in a contacting direction, in the said contacting direction. The insulation displacement channel is delimited on at least one side by the cutting edge of the insulation displacement arm. A wall, which also delimits the insulation displacement channel, or the cutting edge of a further insulation displacement arm can be arranged opposite the cutting edge. If the conductor is pressed further, after its insulation has been cut through, into the tapering insulation displacement channel in the contacting direction, then the insulation displacement contact and also the electrical conductor can undergo elastic deformation at least in certain portions, thus allowing the conductor to be held in a force-transmitting manner by the insulation displacement contact. As a result of the deformation, the insulation displacement channel is at least partially widened and the insulation displacement arm is forced away from the insulation displacement channel. Screwing or soldering of the conductor and the insulation displacement contact is generally not necessary.

Insulation displacement contacts have been used since the start of the 1970s, for example in the field of communications technology, for connecting signal lines. Since then, insulation displacement contacts have also been used in telephone line engineering and in service distribution boards. Connections between conductors and insulation displacement contacts can quite easily conduct electrical currents of up to 16 amps or more.

DE 199 45 412 A1 discloses an insulation displacement contact with two mutually opposing insulation displacement arms which delimit the insulation displacement channel. If the electrical conductor is now introduced into the insulation displacement channel, then the insulation displacement arms undergo deformation and are spread outward away from the insulation displacement channel. When an insulation displacement contact of this type is generally inserted into a housing, on the housing walls of which the insulation displacement arms are supported, the forces generated by the contacting process are transmitted to the walls of the housing.

As housing walls are being made narrower and narrower, for example in order to further miniaturise a contact arrangement, and thus lose rigidity unless further design measures are taken, the contacting forces may be sufficient to significantly deform the walls during the contacting process. This effect is intensified if the housing has a plurality of contact chambers, which are separated from one another by the walls, for insulation displacement contacts. These may be arranged transversely to the insulation displacement channel and next to one another in the direction of deformation of the insulation displacement arms. A contact arrangement having deformed housing walls can, for example, no longer be inserted into a contact assembly. Mechanical interfaces to other components, such as for example to covers for the contact chambers, can also be disturbed as a result so intensively that the components can no longer be connected to the housing.

SUMMARY

It is therefore the object of the invention to provide an insulation displacement contact, which forwards in reduced form forces occurring during contacting processes to housing walls surrounding the insulation displacement contact.

The insulation displacement contact for contacting a sheathed electrical conductor includes at least one insulation displacement arm configured with a respective free end, an insulation displacement portion, and a separation point. The insulation displacement portion positioned along the at least one insulation displacement arm and running away from the free end in a contacting direction. The separation point is located between the free end and the insulation displacement portion. The separation point has increased deformability in a transverse direction, relative to the free end and the insulation displacement portion, the transverse direction runs transversely to the contacting direction.

BRIEF DESCRIPTION OF THE DRAWINGS

Embodiments of the invention are described in greater detail in the following description and are shown in a simplified manner in the drawings, in which.

DETAILED DESCRIPTION OF THE EMBODIMENT(S)

Hereinafter, embodiments of the invention will be described with reference to the drawings.

Figure 1:
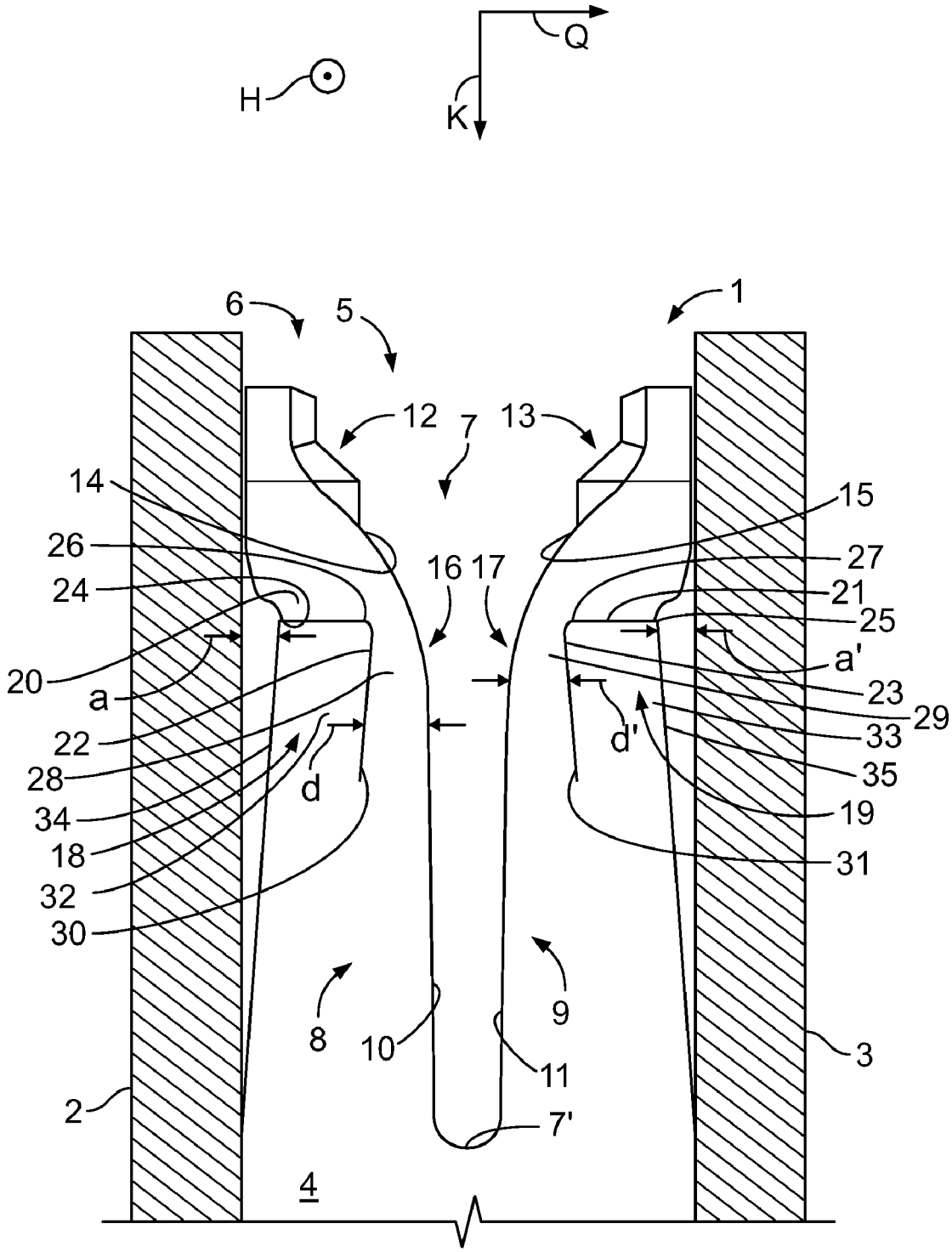
FIG. 1 is partial front view of an insulation displacement contact according to the invention.

With reference to FIG. 1, the insulation displacement contact 1 is shown arranged between two walls 2, 3 of a housing and pressed-together with the walls 2, 3 in the region of its base 4. Alternatively, the insulation displacement contact 1 can also be fastened differently to the walls 2, 3. For example, the insulation displacement contact 1 can be received by the walls 2, 3 in a form-fitting manner or else screwed or adhesively bonded thereto. The connection between the insulation displacement contact 1 and the walls 2, 3 is in this case advantageously formed in such a way that the insulation displacement contact 1 is immovable in relation to the walls 2, 3, in particular in or counter to a contacting direction K.

The insulation displacement contact 1 is shown with two insulation displacement arms 5, 6 that extend counter to the contacting direction K and are formed in one piece with a base 4.

The insulation displacement arms 5, 6 oppose one another in a transverse direction Q, running transversely to the contacting direction K and delimit an insulation displacement channel 7, running in the contacting direction K. The mutually opposing rims of the insulation displacement arms 5, 6 are shaped, at least in insulation displacement portions 8, 9, with cutting edges 10, 11 pointing into the insulation displacement channel 7.

The cutting edges 10, 11 of the insulation displacement arms 5, 6 run substantially parallel to one another and slightly taper the insulation displacement channel 7 in its course.

The insulation displacement channel 7 widens in its course, away from the contacting direction K, and is formed with receiving faces 14, 15 in the region of ends 12, 13 of the insulation displacement arms 5, 6. The receiving faces 14, 15 run away from one another and at least partially counter to the contacting direction K. The receiving faces 14, 15, which are arranged in a substantially V-shaped manner, facilitate an introduction of a conductor into the insulation displacement channel 7.

In the embodiment shown in FIG. 1, the free ends 12, 13 do not rest against the walls 2, 3, and the cutting edges 10, 11 extend up to the free ends 12, 13. The sharpness of the cutting edges 10, 11 can decrease in their course, pointing in the contacting direction K, and they can assume a rounded or even flat shape. This shaping can be advantageous in particular in a rear region, in the contacting direction K, of the insulation displacement channel 7, as the insulation displacement arms 5, 6 can in this way contact the conductor over a larger area than with narrower rims, which remain sharp all the way along the surface. In the region, in which the cutting edges 10, 11 are not shaped so as to be sharp, the sheathing of the conductors can be severed right through to the conductor.

The insulation displacement arms 5, 6 are connected to one another and to the base 4 via an end 7' of the insulation displacement channel 7. Between the insulation displacement portions 8, 9, extending from the base 4 counter to the contacting direction K, and the free ends 12, 13, the insulation displacement arms 5, 6 are formed as separation points 16, 17 through which the insulation displacement portions 8, 9 are connected to the free ends 12, 13. The insulation displacement arms 5, 6 each have a weakened structure 18, 19, in the region of the separation points 16, 17, which locally increases the deformability of the insulation displacement arms 5, 6 here compared to the deformability of the insulation displacement portions 8, 9 or the free ends 12, 13. In particular, the deformability of the separation points 16, 17 transversely to the contacting direction K is increased.

The weakened structures 18, 19 each have a transverse slot 20, 21 running transversely to the contacting direction K and a longitudinal slot 22, 23 which is connected to the transverse slot 20, 21, running substantially and at least partially along the insulation displacement channel 7. The transverse slots and longitudinal slots 20-23 extend, in a height direction H which runs perpendicularly to the contacting direction K and transverse direction Q and points out of the drawing plane, through the insulation displacement contact 1, which is produced from a metal sheet.

The transverse slots 20, 21 have open ends 24, 25 pointing away from the insulation displacement channel 7. The longitudinal slots 22, 23 are connected, in the region of the ends 26, 27 opposing the open ends 24, 25, to the transverse slots 20, 21 and run substantially in the contacting direction K. The weakened structures 18, 19 are therefore substantially L-shaped.

In the region of the separation points 16, 17, the insulation displacement arms 5, 6 continue through material tongues 28, 29, between the insulation displacement portions 8, 9 and the free ends 12, 13. The material thickness d, d', which is measured parallel to the transverse direction Q, of the material tongues 28, 29 which continue the insulation displacement arms 5, 6 all the way along, is lower compared to the insulation displacement portions 8, 9 and the free ends 12, 13. The material tongues 28, 29 extend in the contacting direction K substantially between the transverse slots 21, 22 and the ends 30, 31 of the longitudinal slots 22, 23 that point in the contacting direction K. The material tongues 28, 29 form spring tongues that are elastically deformable transversely to the contacting direction toward the insulation displacement channel 7.

Between the base 4 and the free ends 12, 13, the outsides 32, 33 of the insulation displacement arms 5, 6, that point toward the walls 2, 3, bulge away from the walls 2, 3, so that the insulation displacement contact 1 is formed in a concave manner in the region of the insulation displacement arms 5, 6. In the region of the separation points 16, 17 and in particular in the region of the open ends 24, 25 of the transverse slots 20, 21, there is maximum spacing a, a' between the insides of the walls 2, 3 and the insulation displacement arms 5, 6.

Alternatively, the separation points 16, 17 can also be formed without longitudinal slots 22, 23, so that the material tongues 28, 29 extend between the closed ends 26, 27 of the transverse slots 20, 21 and the insulation displacement channel 7. The material thickness d, d' of the insulation displacement arms 5, 6 is in this case the spacing between the closed ends 26, 27 of the transverse slots 20, 21 and the insulation displacement channel 7.

The portions 34, 35 of the insulation displacement arms 5, 6 that are cut out by way of the L-shaped weakened structures 18, 19 can also be separated off by further transverse slots (not shown here), which can run from the ends 30, 31 of the longitudinal slots 22, 23 up to the arched outsides 32, 33 of the insulation displacement arms 5, 6 that point toward the walls 2, 3.

In a further possible embodiment, the transverse slots 20, 21 can be formed in a wedge-shaped manner and taper in the direction toward the insulation displacement channel 7. Wedge-shaped transverse slots 20, 21 can be provided with open ends 24, 25 pointing toward the insulation displacement channel 7. The transverse slots 20, 21 can also run obliquely to the transverse direction Q or have a curved shape and may in their course change their direction repeatedly. In this case too, longitudinal slots 22, 23 may be dispensed with.

Alternatively, the insulation displacement contact 1 can also be configured with just one insulation displacement arm 5, 6. As a result, the insulation displacement channel 7 may be formed by only one of the insulation displacement arms 5, 6 and one of the cutting edges 10, 11 of the housing wall 2, 3 opposing an insulation displacement arm 5, 6, as soon as the insulation displacement contact 1 is inserted into a housing.

FIGS. 2-5 shows exemplary embodiments of insulation displacement contact 1, the same reference numerals being used for elements corresponding in function and construction to the elements of the exemplary embodiment of FIG. 1. For the sake of brevity, merely the differences from the exemplary embodiment of FIG. 1 will be examined.

Figure 2:
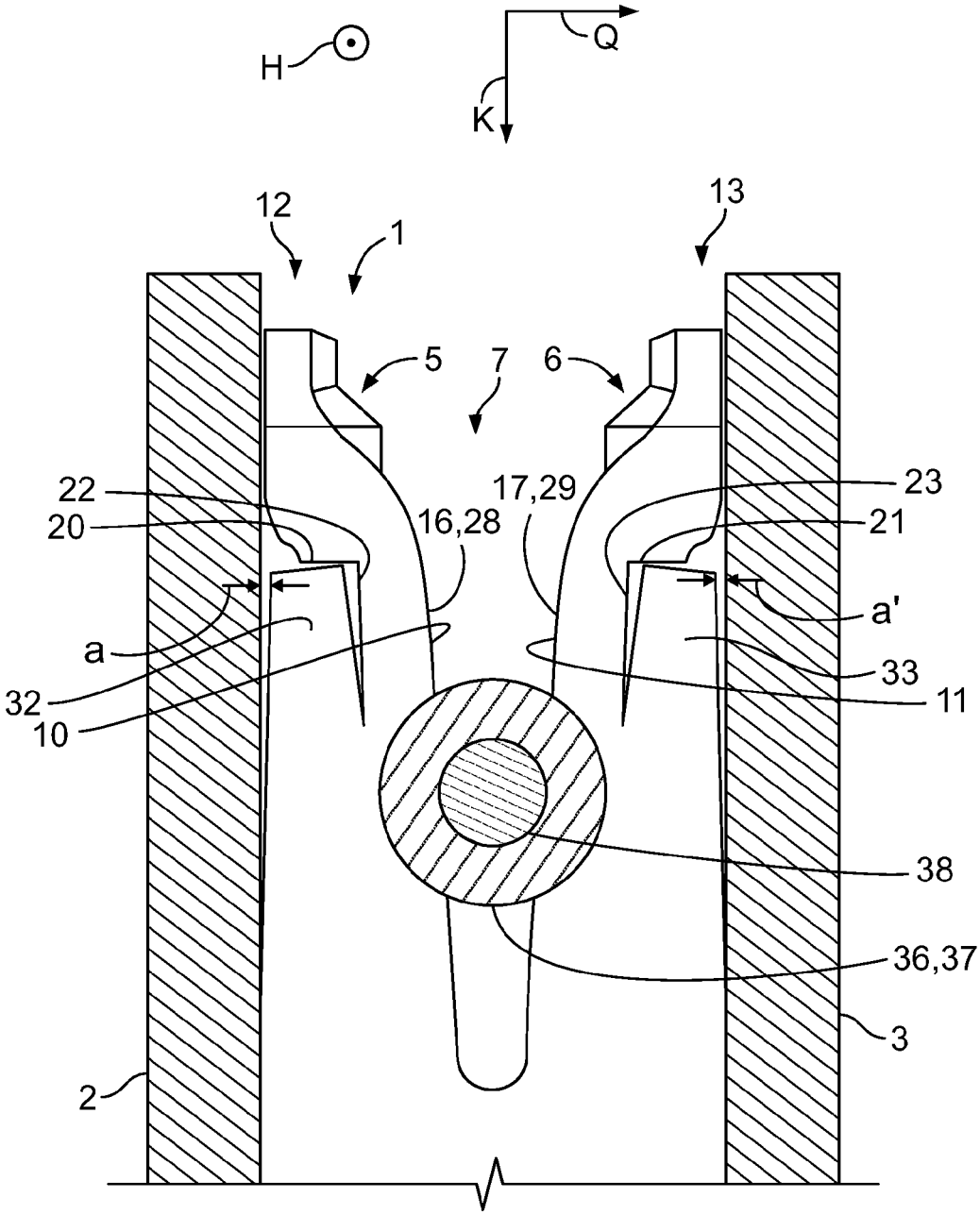
FIG. 2 is partial front view of the insulation displacement contact from FIG. 1 with an electrical conductor plugged into the insulation displacement contact.

FIG. 2 shows the insulation displacement contact 1 from FIG. 1 contacted with an electrical conductor 36. The electrical conductor 36 extends in the height direction H and is introduced into the insulation displacement channel 7 in the contacting direction K. The cutting edges 10, 11 have cut through an electrically insulating sheathing 37 of the electrical conductor 36 and rest, at least in certain portions, against the sheathed core 38 of the conductor 36. The core 38 can consistent of a single wire or else of a plurality of wires combined to form a strand.

At the beginning of the contacting process, the conductor 36 is introduced into the insulation displacement channel 7. The cutting edges 10, 11, which may extend up to the free ends 12, 13, can cut into the sheathing 37, at least in certain portions. The receiving faces 14, 15 can guide the conductor 36, which is moved in the contacting direction K. At the latest at the level of the separation points 16, 17, the sheathing 37 can be cut right through and the core 38 can rest against the receiving faces 14, 15, which now guide the core 38. If the conductor 36 is further introduced into the tapering insulation displacement channel 7, the width of which in the transverse direction Q can be less, at least in certain portions, than the diameter of the core 38, the core 38 is pressed into the insulation displacement channel 7 by the contacting forces acting in the contacting direction K and thus clamped. The insulation displacement channel 7 is widened in this case at least partially in the transverse direction Q.

The electrical conductor 36 has been pressed into the insulation displacement channel 7 during the contacting processes in the contacting direction K in such a way that it is clamped between the insulation displacement arms 5, 6. The insulation displacement arms 5, 6 deflect away from the insulation displacement channel 7 transversely to the contacting direction K by the forces acting thereupon during the contacting process.

The insulation displacement arms 5, 6 perform this forced movement uniformly, substantially over their entire length, running along the contacting direction K. However, as soon as the free ends 12, 13 rest against the insides of the walls 2, 3, the movements of the free ends 12, 13 are uncoupled from the movements of the insulation displacement portions 8, 9. The free ends 12, 13 do not move any further inward or counter to the transverse direction Q. However, the insulation displacement portions 8, 9 move further in the direction toward the walls 2, 3. As a result, the concavity of the insulation displacement contact 1 decreases. In particular, the spacings a, a' between the insulation displacement arms 5, 6 and the walls 2, 3 decrease compared to the starting position, which is illustrated in FIG. 1.

Forces acting on the housing walls 2, 3 through the free ends 12, 13 are determined largely by the rigidity of the insulation displacement contact 1, which is in this case locally reduced compared to the rest of the insulation displacement arms 5, 6, of the material tongues 28, 29. The acting contacting forces are transmitted only to a minor extent to the walls 2, 3.

The separation points 16, 17 form plastically deformable joint portions. These joint portions define predetermined buckling points, the deformation of which allows the uncoupled relative movements between the free ends 12, 13 and the insulation displacement portions 8, 9. If the joint portions are plastically deformable, it may be the case that the insulation displacement contact 1 remains deformed after the removal of the conductor 36 and can no longer be used for secure contacting with a conductor 36, at a later time. However, if the joint portion is formed in such a way that it is substantially elastically deformed during a contacting process, the insulation displacement arms 5, 6 can return, after removal of the contacted conductor 36, substantially to their original shape and may even be used for at least one further contacting process.

Both the free ends 12, 13 and the insulation displacement portions 8, 9 are formed in a rigid manner compared to the separation points 16, 17, and are deformed in their course only slightly, if at all, by way of the contacting process.

The transverse slots 20, 21 and the longitudinal slots 22, 23 are shown in this case spread open in a wedge-shaped manner. However, it can also occur that only the transverse slots 20, 21 are spread open. The longitudinal slots 22, 23 can, for example, be pressed-together by the acting contacting forces. The cut-out portions 32, 33 do not touch the walls 2, 3 and do not transmit any forces either between the insulation displacement portions 8, 9 and the free ends 12, 13.

Figure 3:
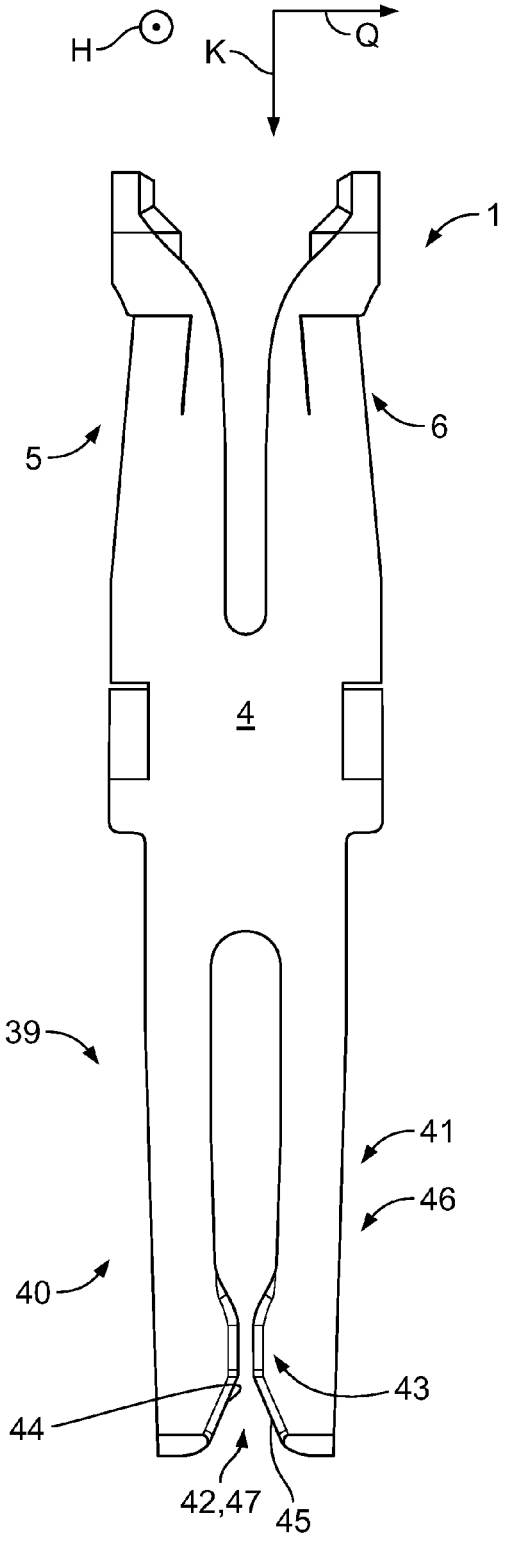
FIG. 3 is a front view of a further exemplary embodiment of the insulation displacement contact.

As shown in FIG. 3, the insulation displacement contact 1 with a contacting region 39. The contacting region 39 is connected to the base 4 so as to be apart from the insulation displacement arms 5, 6. In the embodiment shown, two contact pins 40, 41 of the contacting region 39 extend away from the base 4 in the contacting direction K. The two contact pins 40, 41 are made, together with the rest of the insulation displacement contact 1, from one piece of sheet metal and arranged, together with the insulation displacement arms 5, 6 and the base 4, in a contact plane spanned by the contacting direction K and the transverse direction Q. Both the insulation displacement arms 5, 6 and the contact pins 40, 41 oppose one another in this contact plane, in each case in the transverse direction Q. A clamping channel 42, which serves to receive a mating contact which may be configured in a complementary manner, runs between the contact pins 40, 41.

The mating contact can be, for example, configured as a contact pin, which may be in the form of a male tab connector, one or more contact sockets or else as a circuit board with printed-on conductors. In its course pointing in the contacting direction K, the clamping channel 42 has a constant width at least in certain portions, but tapers at its end positioned in the contacting direction K up to a bottleneck 43 via which the electrical contact, for example to the printed-on lines on the circuit board or printed circuit board, can be produced. After the bottleneck 43 in the contacting direction K, the clamping channel 42 widens and forms centering faces 44, 45 that facilitate an insertion of the mating contact into the clamping channel 42. The contact pins 40, 41 can be resiliently deflected transversely to the contacting direction K and form a contact clamp 46 for securely mounting the mating contact.

As an alternative to the orientation shown here, the contact clamp 46 can also run perpendicularly to the contact plane in the direction of the contacting direction K and the height direction H and the open end 47 of the clamping channel 42 can also point in or counter to the height direction H.

Figure 4:
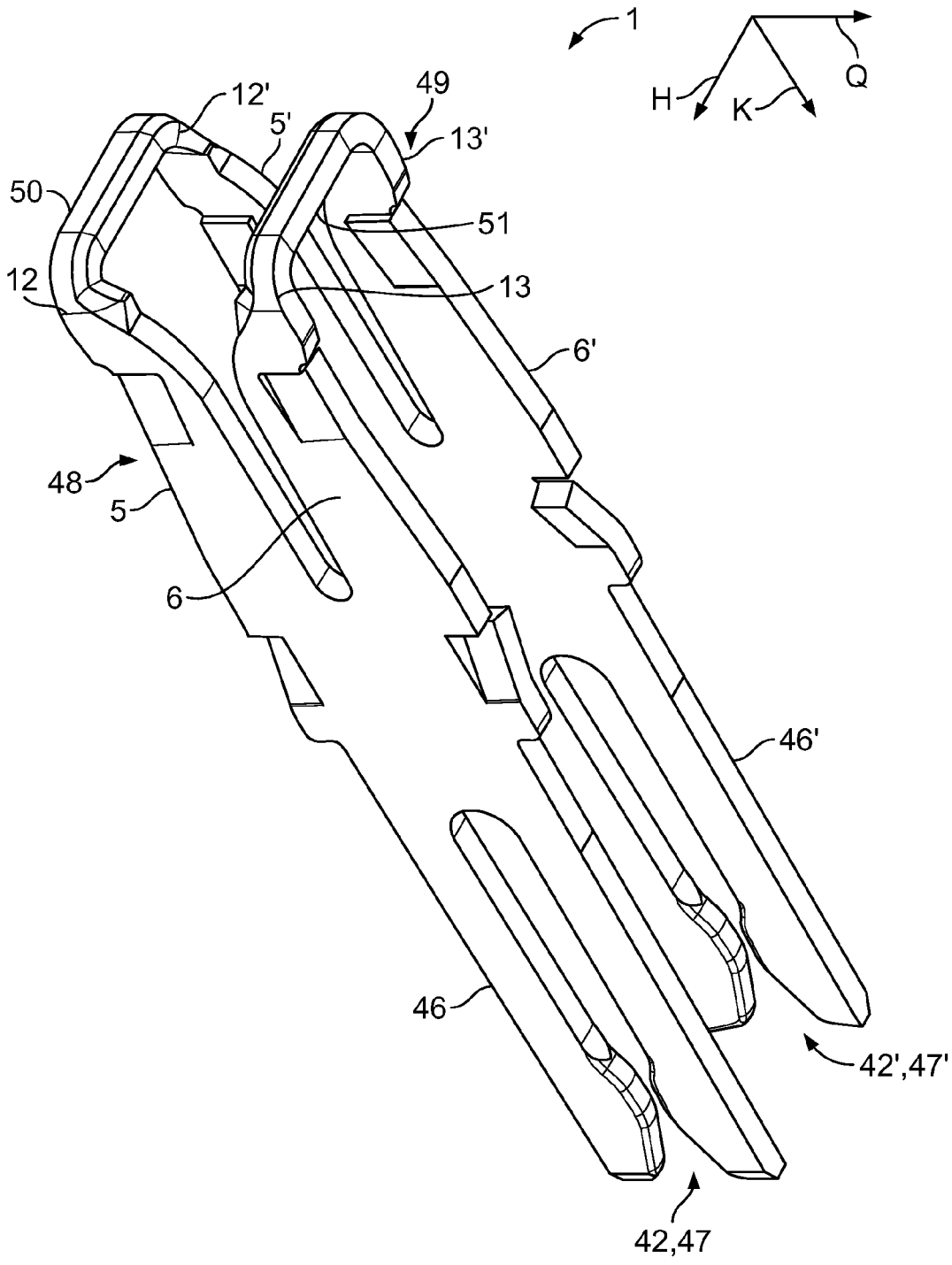
FIG. 4 is a perspective view of a further exemplary embodiment of the insulation displacement contact.

FIG. 4 shows the insulation displacement contact 1 with four insulation displacement arms 5, 5', 6, 6'. The insulation displacement arms 5, 6 form a first insulation displacement pair 48; the insulation displacement arms 5', 6' form a second insulation displacement pair 49.

The insulation displacement pairs 48, 49 run parallel to the contact plane and to one another. In the height direction H, the two insulation displacement pairs 48, 49 are arranged set apart from one another. The insulation displacement pairs 48, 49 are shaped substantially mirror-symmetrically to one another about a plane of symmetry which is arranged centrally between the insulation displacement pairs 48, 49 and runs parallel to the contact plane.

The ends 12, 13 of the first insulation displacement pair 48 that point counter to the contacting direction K are connected via a respective connecting bridge 50, 51 to the free ends 5', 6' of the second insulation displacement pair 49 that also point counter to the contacting direction K. The connecting bridges 50, 51 extend substantially parallel to the height direction H and flank the insulation displacement channel 7 which extends in the contacting direction K and height direction H. The connecting bridges 50, 51 are arranged before and after the insulation displacement channel 7 respectively in the transverse direction Q and rigidly connect the free ends 5, 5', 6, 6' to one another.

The insulation displacement contact 1 shown in this figure is formed with two contact clamps 46, 46' which are oriented parallel to one another and to the contact arm plane. As also described in the exemplary embodiment of FIG. 3, the contact clamps 46, 46' can also run in a twisted manner in relation to the contact arm plane and in particular so as to be arranged at an angle of 90° relative to the contact plane. Even the open ends 47, 47' of the contacting channels 42, 42' can point in a different direction and for example in the height direction H or else in the transverse direction Q.

Figure 5:
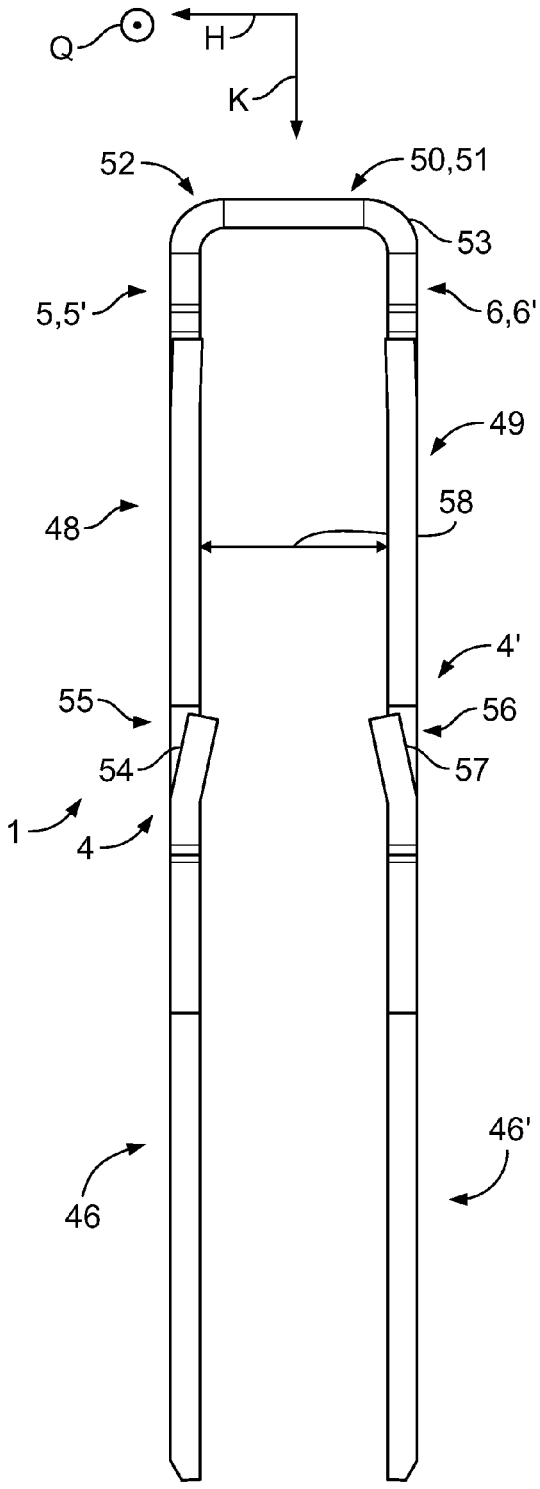
FIG. 5 is a side view of the insulation displacement contact shown in FIG. 4.

FIG. 5 is a side view of the exemplary embodiment of FIG. 4 counter to the transverse direction Q, the same reference numerals being used for elements corresponding in function and construction to the elements of the exemplary embodiments of the preceding figures. For the sake of brevity, merely the differences from the foregoing exemplary embodiments will be examined. It may be seen in FIG. 5 that the insulation displacement contact 1 has a substantially U-shaped cross section running in a plane spanned by the height direction H and contacting direction K. The insulation displacement contact 1, which is formed as a punched part from a metal sheet, is bent, in the example illustrated here through 90° in each case, in order to produce the insulation displacement contact 1 in bending regions 52, 53 arranged between the free ends 5, 5' and 6, 6' respectively and the connecting bridges 50, 51. The two insulation displacement pairs 48, 49 are in this case moved toward one another. In the region of the bases 4, 4', the insulation displacement contact 1 is shaped with a total of four latching elements 54 to 57. The latching elements 54 to 57 are partially punched out of the bases 4, 4', but connected in one piece to the bases 4, 4' via regions pointing in the contacting direction K.

If the insulation displacement contact 1 is not arranged between two walls 2, 3, but rather fitted to one of the walls 2, 3, of which the width running along, the height direction H substantially corresponds to the clear width between the first and the second insulation displacement pair 48, 49, then the latching elements 54 to 57 can interact as barbs with the wall 2, 3. Thus, the latching elements 54 to 57 can at least impede undesirable detachment of the insulation displacement contact 1 from the wall 2, 3 counter to the contacting direction K and thus secure the position of the insulation displacement contact 1 relative to the wall 2, 3.

The solution according to the invention is simple in terms of design and has the advantage that the movement of the free end 12, 13 during the contacting process is uncoupled from the forced movement of the insulation displacement portion 8, 9. Additionally, the forces, occurring during the contacting process, are applied substantially only by way of the insulation displacement portion 8, 9 and absorbed by the insulation displacement contact 1.

The movements of the free end 12, 13 and the insulation displacement portion 8, 9 can be made possible by the increased deformability of the separation point 16, 17 in which the deformation of the insulation displacement arm 5, 6 can be concentrated.

In order for the insulation displacement arm 5, 6 to be able to have the increased deformability in the region of the separation point 16, 17, the separation point 16, 17 can be formed as an elastically deformable joint portion, as discusses. For example, the joint portion can be formed as a ball joint and comprise a spring element which can orient the free end 12, 13 in the starting position in such a way that the insulation displacement channel 7 can widen counter to the contacting direction and be delimited at least by a receiving face, provided at the free end 12, 13, for the conductor 36.

Preparing a multi-part configuration of this type, having the aforementioned separation point 16, 17, can be difficult to achieve and prone to error. It is therefore advantageous if the separation point 16, 17 is formed in a less complex manner. For example, the insulation displacement arm 5, 6 can have a predetermined buckling point, between the insulation displacement portion 8 and the free end 12, which can have reduced rigidity compared to the free end 12, 13 and to the insulation displacement portion 8, 9.

The separation point 16, 17, shaped as the material tongue 28, 29, can connect the free end 12, 13 to the insulation displacement portion 8, 9. This material tongue 28, 29 can be punched out, together with the rest of the insulation displacement contact 1, from a metal sheet, wherein the rigidity of the material tongue 28, 29 can be weakened, for example by a stamping process. Thus, the material tongue 28, 29 can in particular be more readily elastically deformable in the transverse direction than the rest of the insulation displacement arm 5, 6. The material tongue 28, 29 can, in particular, be configured as a spring tongue, which can be deflected in the direction toward the insulation displacement channel 7.

In order to increase the deformability of the insulation displacement arm 5, 6, in the region of the separation point 16, it is possible to provide there at least one weakened structure 18, 19, which can locally reduce the material thickness of the insulation displacement arm 5, 6, in the region of the separation point 16, 17. The weakened structure 18, 19 can, for example, be introduced into the insulation displacement arm 5, 6 during the punching-out process or during a stamping process for producing the insulation displacement contact 1. However, at least the insulation displacement arm 5, 6, and in particular the region thereof that is provided with the weakened structure 18, 19, can be formed so as to be rigid in the contacting direction.

For example, the weakened structure 18, 19 can be shaped as a slot cutting into the insulation displacement arm 5, 6. This slot can run at least partially transversely to the insulation displacement arm 5, 6, or in the transverse direction and be shaped as the transverse slot 20, 21. The transverse slot 20, 21 can have an open end 24, 25, which points away from a cutting edge 10, 11, running in the contacting direction K, of the insulation displacement arm 5, 6. The transverse slot 20, 21 of this type may be produced immediately during the punching-out process of the insulation displacement contact 1 and requires no further production step. The edge portions 34, 35, which delimit the transverse slot 20, 21 in the contacting direction, of the insulation displacement arm 5, 6 can be embodied in a form-fitting manner and so as to rest against one another when not contacted with the conductor 36.

Deformation, concentrating on the separation point 16, 17, can be focused so intensively in the region of the insulation displacement arm 5, 6 that the insulation displacement arm 5, 6 can wear or even tear here during operation. It can therefore be advantageous, if the weakened structure 18, 19 expands also in the contacting direction K. For this purpose, the weakened structure 18, 19 can therefore additionally have a longitudinal slot 22, 23 extending substantially along the insulation displacement channel 7. The longitudinal slot 22, 23 extending substantially parallel to the contacting direction can be connected to the closed end 26, 27 of the transverse slot 20, 21 that opposes the open end 24, 25, so that the weakened structure 18, 19 can be formed in a substantially L-shaped manner. In particular, the longitudinal slot 22, 23 can run through at least one portion of the insulation displacement arm 5, 6 and point away from the open end 24, 25 of the insulation displacement channel 7 in the contacting direction. In a transition region, in which the longitudinal slot 22, 23 is connected to the transverse slot 20, 21, the weakened structure 18, 19 can be formed as a connecting slot which is angled or curved in its course and connects the longitudinal slot 22, 23 to the transverse slot 20, 21.

Alternatively, the weakened structure 18, 19 can also be formed as an arcuate slot, the open end 24, 25 of which can point substantially away from the insulation displacement contact 1. In the course of the slot, its direction of curvature can also change a plurality of times. The end 26, 27 of the slot that ends in the insulation displacement arm 5, 6 can be oriented in any desired manner and be arranged preferably, so as to point in or counter to the contacting direction K.

The deformation of the insulation displacement arm 5, 6 that is concentrated onto the separation point 16, 17 can now be distributed over the length, running in the contacting direction K, of the material tongue 28, 29, which can extend substantially completely along the longitudinal slot 22, 23 and be arranged between the longitudinal slot 22, 23 and the insulation displacement channel 7. As a result of this distribution of the deformation along the longitudinal slot 22, 23, the material loading of the separation point 16, locally, is decreased, so that damage of the insulation displacement contact 1 brought about by overloading can be minimized.

The insulation displacement contact 1 can have at least two insulation displacement arms (5, 5', 6, 6') that can extend in a common contact plane. The mutually opposing cutting edges (10, 10', 11, 11') of which can delimit the insulation displacement channel 7. This configuration has the advantage that the insulation sheathing 37 of the electrical conductor 36 can be cut through at least two sides, and the core 38 of the conductor 36 can be connected in an electrically conductive manner to the insulation displacement contact 1 through at least two contact faces.

In the embodiment shown in FIG. 2, the conductor 36 is fixed by the two insulation displacement arms 5, 6 in its longitudinal direction exclusively in a portion, so that the conductor 36 is freely movable above and below the insulation displacement contact 1. It is possible that the conductor 36, which is in this way contacted with the insulation displacement contact 1, may be insufficiently clamped in the insulation displacement channel 7 and become detached therefrom; this can cause the electrical connection to malfunction. The connection between the conductor 36 and insulation displacement contact 1 can be greatly improved if the insulation displacement contact 1 has at least four insulation displacement arms (5, 5', 6, 6'), as shown in FIG. 4. This improvement may not only affect the mechanical fixing of the conductor 36 in the insulation displacement channel 7, but also benefit the electrical conductivity of the connection. The security of both the electrical and the mechanical connection can, in this case, be twice as high compared to two insulation displacement arms (5, 5', 6, 6').

Two of the at least four insulation displacement arms (5, 5', 6, 6') can each form insulation displacement pairs 48 arranged parallel to the contact arm plane, wherein the free ends 12 of both insulation displacement contacts of a first insulation displacement pair 48 can be connected to in each case one of the free ends 12 of the insulation displacement arms (5, 5', 6, 6') of a second insulation displacement pair 48 via respective connecting bridges 50. The connecting bridges 50 define the spacing of the two insulation displacement pairs 48 along a height direction, running parallel to the longitudinal direction of the conductor 36, of the insulation displacement contact 1. Furthermore, the connecting bridges 50 can rigidly connect the free ends 12 of the insulation displacement pairs 48 to one another and strengthen the ends 12 of the insulation displacement contact 1 that point counter to the contacting direction in such a way as to at least hinder a movement of the free ends 12 that is not directed onto the insulation displacement channel 7. This allows damage to the insulation displacement arms (5, 5', 6, 6') and in particular the separation points 16 to be avoided even if the conductor 36 is inserted incorrectly into the insulation displacement channel 7. The connecting bridges 50 can be arranged in such a way that they flank the open end 24 of the insulation displacement channel 7 and can thus facilitate insertion of the conductor 36 into the insulation displacement channel 7 by guiding the conductor 36.

Set apart from the insulation displacement arms (5, 5', 6, 6'), the insulation displacement contact 1 can have at least one contacting region 39 with at least two contact pins 40 (see FIG. 3). The contact pins 40 can for example be plugged into one or more contact sockets which are configured so as to be substantially complementary to the contact pins 40. In order to be able to connect the insulation displacement contact 1, for example, also to a printed circuit board, the contact pins 40 can together form an elastically deformable contact clamp 46, which can surround a clamping channel 42 opening away from the insulation displacement contact 1. The contact pins 40 can be shaped so as to be able to be deflected resiliently away from the clamping channel 42 and the contact clamp 46 can receive in an at least partially force-transmitting manner the printed circuit board or another mating contact which is configured in a planar manner, at least in certain portions 34.

The contact clamp 46 can be arranged parallel or perpendicularly to the contact arm plane. This has the advantage that differently configured insulation displacement contacts can be used in various mounting situations. The open end 24 of the clamping channel 42 can point in the contacting direction or else in or counter to the height direction. This measure also allows insulation displacement contacts configured in this way to be appropriately selected for use in a broad range of mounting situations.

In order to be able to improve both the electrical contact between the insulation displacement contact 1 and the mating contact (not shown) and also the mechanical connection between these two elements, the insulation displacement contact 1 can have, in its contacting region 39, at least two contact clamps 46. Above all if the insulation displacement contact 1 is to be connected to a printed circuit board, the contact clamps 46 can be formed parallel to one another and with mutually overlapping clamping channels. This allows the insulation displacement contact 1 to be connected to the mating contact so as to be protected more effectively from twisting or tilting. It is also possible for the insulation displacement contact 1 to be able to be connected via its contacting region 39 to male tab connectors, which can have a thickness of 0.8 mm.

In order to produce the insulation displacement contact 1, a punching process, with the aid of which the insulation displacement contact 1 can be punched out of a metal sheet, is sufficient in a first step. If necessary, the cutting edge 10 can be formed on the punched-out insulation displacement contact 1 in a further production step. If the metal sheet is sufficiently thin in the height direction, it may be possible to dispense with a subsequent formation of the cutting edge 10. In particular if the insulation displacement contact 1 is to have a plurality of insulation displacement pairs 48, the punching process can also be followed by a bending process by way of which the insulation displacement pairs 48 are arranged one above another, set apart from one another in the height direction. During or after the punching process, latching elements 54 can be shaped via a stamping process.

While the embodiments of the present invention have been illustrated in detail, it should be apparent that modifications and adaptations to those embodiments may occur. The scope of the invention is therefore limited only by the following claims.

The invention claimed is:

1. An insulation displacement contact for contacting a sheathed electrical conductor, comprising:

at least one insulation displacement arm;

a respective free end at one end of the at least one insulation displacement arm;

an insulation displacement portion running along at least one insulation displacement arm in a contacting direction and away from the free end;

a separation point located between the free end and the insulation displacement portion and having increased deformability relative to the free end and the insulation displacement portion, the increased deformability running in a transverse direction to the contacting direction and;

at least one weakened structure which locally reduces the material thickness of the insulation displacement arm, the weakened structure having a free end extending opposite to the contacting direction, and a transverse slot on an outer side of the insulation displacement arm opposite the insulation displacement portion, running at least partially in the transverse direction and having an open end which points away from a cutting edge of the insulation displacement arm.

2. The insulation displacement contact according to claim 1, wherein the separation point forms a deformable joint portion.

3. The insulation displacement contact according to claim 2, wherein the separation point is located in the region of the at least one weakened structure and is formed as a predetermined buckling point.

4. The insulation displacement contact according to claim 1, wherein the separation point is shaped as a material tongue connecting the free end to the insulation displacement portion.

5. The insulation displacement contact according to claim 1, wherein the weakened structure comprises a longitudinal slot extending substantially along the contacting direction and running through at least one portion of the insulation displacement arm, the longitudinal slot connected to an end of the transverse slot so as to form a substantially L-shaped weakened structure.

6. The insulation displacement contact according to claim 1, wherein the insulation displacement contact comprises at least two insulation displacement arms having mutually opposing cutting edges to cut through the sheathing of the electrical conductor.

7. The insulation displacement contact according to claim 6, wherein the insulation displacement arm delimits an insulation displacement channel running in the contacting direction, the mutually opposing cutting edges pointing into the insulation displacement channel.

8. The insulation displacement contact according to claim 1, wherein the insulation displacement contact comprises:

at least four insulation displacement arms having respective free ends at one end of each of the at least four insulation displacement arms, two of the insulation displacement arms oppose one another within a first insulation displacement pair and a second insulation pair;

wherein the free ends of both insulation displacement arms of the first insulation displacement pair rigidly connect to one of the free ends of the insulation displacement arms of the second insulation displacement pair through a respective connecting bridge.

9. The insulation displacement contact according to claim 8, wherein the connecting bridge flanks an open end of the insulation displacement channel.

10. The insulation displacement contact according to claim 1, wherein the insulation displacement contact has a contacting region positioned apart from the at least one insulation displacement arm.

11. The insulation displacement contact according to claim 10, wherein the contacting region comprises at least two contact pins which together form an elastically deformable contact clamp, the contact clamp surrounding a clamping channel opening away from the insulation displacement contact.

12. The insulation displacement contact according to claim 11, wherein the contact clamp extends parallel or perpendicularly to a contact arm plane.

13. The insulation displacement contact according to claim 11, wherein the insulation displacement contact includes at least two contact clamps oriented parallel to one another.

14. The insulation displacement contact according to claim 1, wherein at least two insulation displacement arms that extend counter to the contacting direction and are formed in one piece with a base.

15. The insulation displacement contact according to claim 14, further comprises at least one latching element in the region of the bases.

16. The insulation displacement contact according to claim 15, wherein the latching elements are partially punched out of the bases and connected in one piece to the bases pointing in the contacting direction.

* * * * *